United States Patent [19]

Molins

[11] Patent Number: 4,848,372

[45] Date of Patent: Jul. 18, 1989

[54] CIGARETTE TURNING APPARATUS

[75] Inventor: Desmond W. Molins, High Wycombe, England

[73] Assignee: Molins PLC, Lindon, England

[21] Appl. No.: 20,886

[22] Filed: Mar. 2, 1987

[30] Foreign Application Priority Data

Feb. 28, 1986 [GB] United Kingdom ..... 8604997

[51] Int. Cl.[4] ..... A24C 5/35; B65G 15/14

[52] U.S. Cl. ..... 131/282; 131/94; 131/283; 198/405

[58] Field of Search ..... 198/405; 131/280, 281, 131/282, 283, 95, 94, 96

[56] References Cited

U.S. PATENT DOCUMENTS

| | | | |
|---|---|---|---|
| 2,929,489 | 3/1960 | Parrish | 198/405 |
| 2,965,215 | 12/1960 | Molins | 198/405 |
| 2,988,199 | 6/1961 | Pinkham | 198/405 |
| 4,479,574 | 10/1984 | Julius et al. | 198/405 |

FOREIGN PATENT DOCUMENTS

| | | | |
|---|---|---|---|
| 0818684 | 9/1959 | United Kingdom | 198/405 |

*Primary Examiner*—V. Millin

*Attorney, Agent, or Firm*—Antonelli, Terry & Wands

[57] ABSTRACT

Filter tipped cigarettes are turned end for end by a narrow flexible belt (10) which is twisted in a figure of eight about pulleys (13, 14). The belt (10) has flutes (8) which engage only the tipped ends (T). A tensioned thin flexible strip (22) covers the open sides of the flutes (8) to retain the cigarettes while being turned, and endwise movement of the cigarettes is prevented by a fixed guide (26).

In a modification, a belt (34) has flutes (32) formed in opposite sides and extends between pulleys (36,38), with a single 180 degree twist in the upper run. After being tip-turned, the cigarettes are removed from the inner side of the belt by suction in flutes 50 and moved endwise by a cam (60) away from belt (34) for transfer to a drum 62. Belt (34) may have flutes in only one side, in which case a second 180 degree twist is formed in the lower run.

12 Claims, 3 Drawing Sheets

CIGARETTE TURNING APPARATUS

This invention relates to apparatus for turning filter-tipped cigarettes end for end. This operation is commonly referred to as tip-turning.

Cigarettes or like smoking articles having a filter tip at one end thereof are usually made by feeding a double-length filter between two axially aligned cigarette lengths, wrapping a piece of tipping material around the filter and the adjacent ends of the cigarettes, and then cutting the filter mid-way along its length to form two tipped cigarettes, with the tipped ends facing each other. When the cigarettes are packed it is desirable to have the tipped ends all facing in the same direction, which requires one of the rows of cigarettes to be tip-turned.

It is known to tip-turn cigarettes by conveying them sideways by means of endless bands which grip the cigarettes between them and are twisted in figure of eight configurations, so as to rotate the cigarettes through 180 degrees about an axis extending in the direction of movement of the cigarettes. Such arrangements are complicated and have not been successful.

According to the present invention there is provided apparatus for tip-turning cigarettes comprising first and second conveyor means for feeding cigarettes sideways in succession and spaced apart in the direction of feed, an endless twisted flexible belt adapted to receive cigarettes from said first conveyor means, to tip-turn the cigarettes and to deliver the tip-turned cigarettes to the second conveyor means, said endless belt having flutes therein to receive the cigarettes from the first conveyor means, and cover means adapted to extend along the open sides of the flutes to retain the cigarettes in their respective flutes whilst being tip-turned. Conveniently the flexible belt extends between two spaced pulleys on opposite sides of the conveyance path of the cigarettes and is formed in a figure of eight configuration.

In a preferred arrangement the cover means comprises a stationary flexible strip, fixed at both ends thereof, and tensioned so as to retain the cigarettes in flutes. In an alternative arrangement the cover means may comprise an endless band, twisted in a figure of eight configuration and driven in unison with the endless belt, and positioned so that one of its runs lies across the open side of all of said flutes containing a cigarette.

The apparatus may further comprise stop means engaging the ends of the cigarettes to prevent endwise downward movement of the cigarettes in their respective flutes under gravity while being turned. Conveniently said stop means may comprise a stationary guide positioned adjacent to the ends of the flutes in the region where they contain cigarettes. Alternatively said stop means may comprise parts integrated with or secured to the belt.

The invention will now be described, by way of example only, with reference to the accompanying drawings in which.

Figure 1:
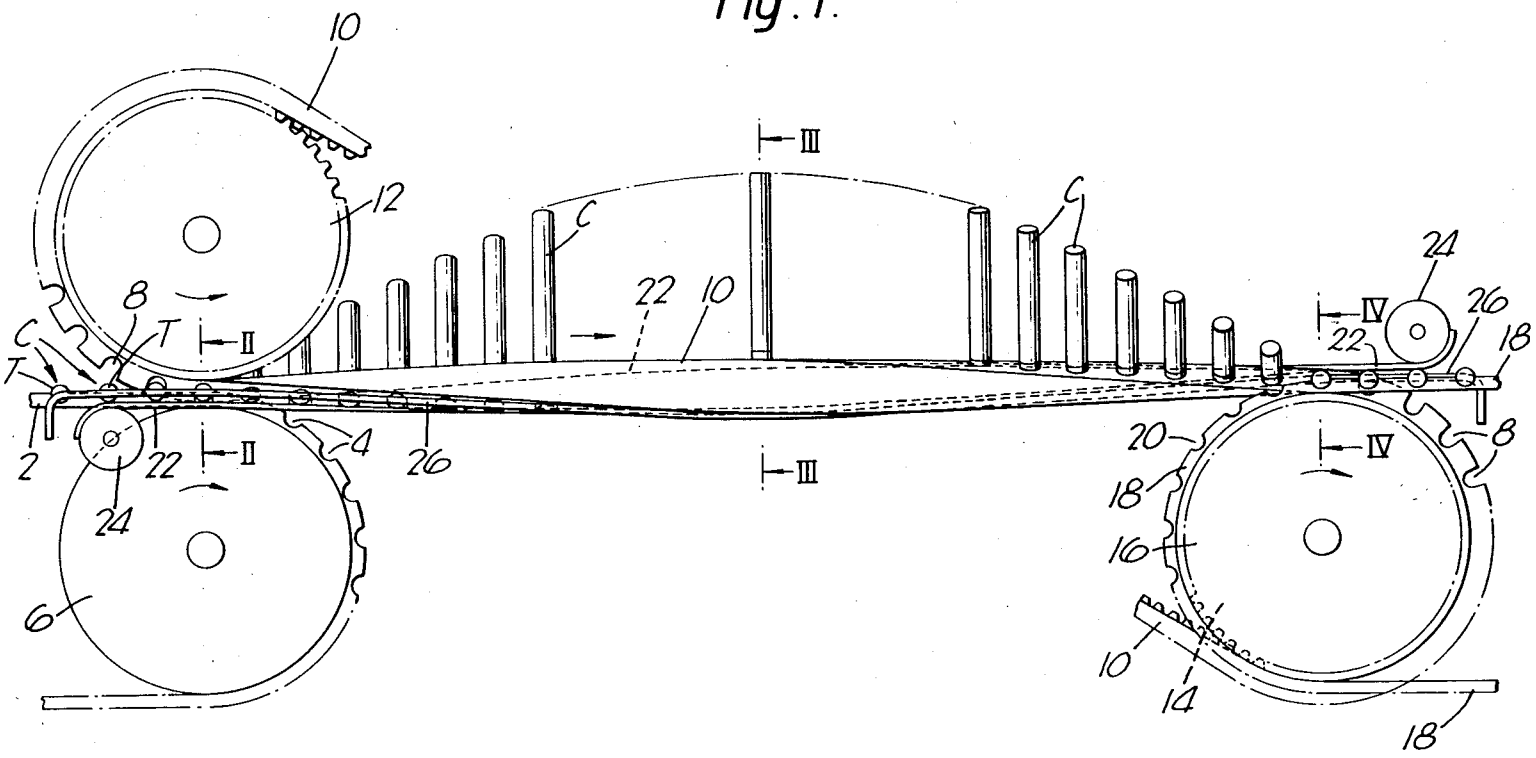
FIG. 1 is a diagrammatic side view of apparatus for turning cigarettes end for end.
Figure 2:
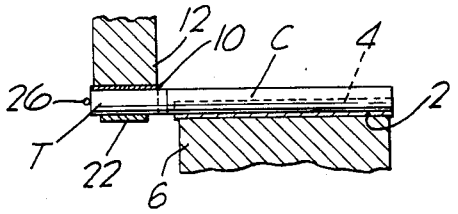
FIG. 2 is a section taken on the line II—II of FIG. 1.
Figure 3:
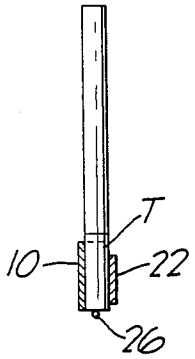
FIG. 3 is a section taken on the line III—III of FIG. 1.

In FIG. 1 a row of filter tipped cigarettes C, with their tipped ends T facing the same way, is fed sideways towards the right by a conveyor 2 provided with flutes 4 each of which carries a cigarette C. The cigarettes lie in the flutes 4 so that their tipped ends T extend beyond the end of the flutes, as shown in FIG. 2. At its right-hand end the conveyor 2 passes round a pulley 6.

Figure 4:
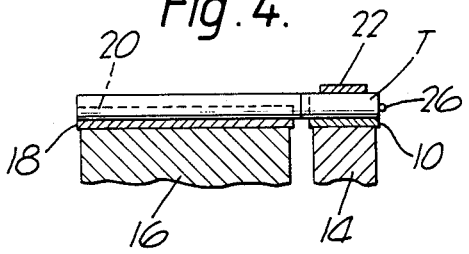
FIG. 4 is a section taken on the line IV—IV of FIG. 1.

As the cigarettes approach the top dead centre of pulley 6 the cigarettes C enter flutes 8 formed in one face of a narrow endless flexible belt 10 which continues their sideways feed. The belt 10, which extends between two toothed pulleys 12, 14 and is similarly toothed on its other side, is of a width such that the flutes 8 engage only the tipped ends T of the cigarettes, as shown in FIG. 2. The pulleys 12 and 14 lie on opposite sides of the horizontal conveyance path of the cigarettes (i.e. respectively above and below the path), and the belt 10 is twisted in a figure of eight configuration (FIG. 1) so that as the cigarettes are fed sideways they are turned end for end to bring the tipped ends T facing in the opposite direction. Mounted co-axially with the pulley 14 is a further pulley 16 (FIG. 4) around which passes a second conveyor 18 provided with flutes 20 which receive the cigarettes C from the belt 10 and continue their sideways movement to further apparatus which forms no part of the present invention. The belt 10 may be of a composite structure, the side having the teeth which engage pulleys 12, 14 being formed of hard rubber, and the side having the flutes 8 formed in it being of a softer foam rubber.

The flutes 8 in belt 10 have a cross-sectional width and depth which are substantially equal to (or slightly less than) the diameter of cigarettes C. To hold each cigarette in its respective flute whilst being turned end for end, a thin flexible cover strip 22 is provided which has its opposite ends fixed to spaced blocks 24 so as to be under enough tension to keep the strip taut. The strip 22 is twisted along its length so that it lies along belt 10 and covers the open side of all those flutes 8 which contain cigarettes. In a modified arrangement, the strip 22 is replaced by an endless belt (not shown) which extends between two rollers, instead of the blocks 24, and is driven at the same speed as the belt 10.

To prevent any endwise downward movement of the cigarettes in the flutes 8 as they are being turned, a fixed guide 26 is positioned, as shown, alongside the belt 10 so as to lie against the tipped ends T of the cigarettes. The guide 26 is formed with a helical twist so that it follows the twist in the belt 10. In a modification each flute 8 may be formed with an integral end wall to prevent such endwise movement of the cigarettes. To prevent the two runs of belt 10 from rubbing against each other where they cross, a stationary plate (not shown) may be positioned between the two runs.

Although only a single row of cigarettes C is shown, it will be appreciated that in practice a cigarette making machine produces two rows of cigarettes with their tipped ends facing in opposite directions. One row may be tip-turned as described above, whilst the other row is fed, unturned, alongside it. The other row may, for example, then be fed to flutes on a conveyor similar to conveyor 18, the flutes being positioned intermediate the flutes 20.

Figure 5:
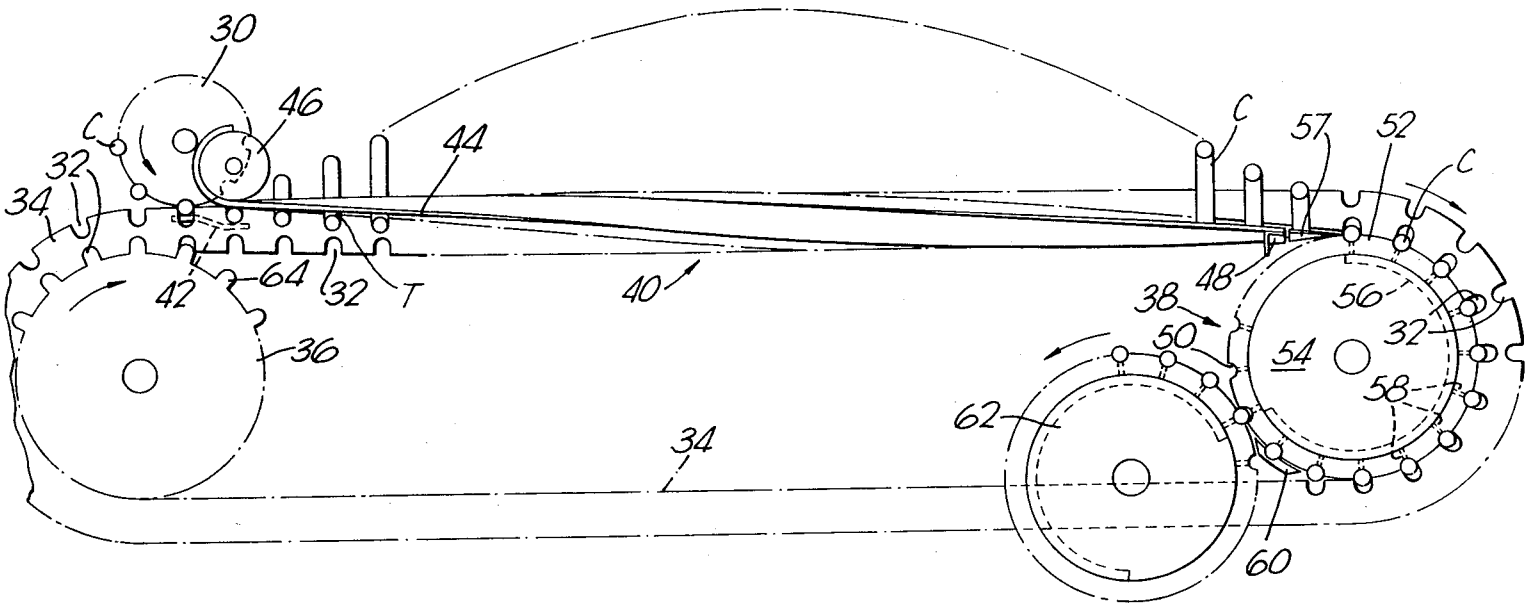
FIG. 5 is a diagrammatic side view similar to FIG. 1 but showing a modified form of apparatus.

FIG. 5 shows an alternative apparatus in which the belt forms a simple loop around two pulleys, instead of the figure of eight configuration shown in FIG. 1. A row of filter tipped cigarettes C is fed to the right by a fluted drum 30, the cigarettes lying in the flutes with their tipped ends T extending beyond the ends of the flutes. The cigarettes may be held in the flutes by suction or by a known form of guide plate (not shown).

From drum 30 the cigarettes are fed into flutes 32 formed in both faces (as shown in FIG. 5) of a narrow endless flexible belt 34 which serves to feed the cigarettes to the right and also turns them through 180 degrees in a similar way to the belt 10 described above. For this purpose the belt 34 is formed with a single 180 degree twist and extends between pulleys 36, 38, with the twist occurring along the upper run 40 of the belt 34 in the direction of feed of the cigarettes. Due to the belt 34 having flutes 32 formed in both its inward and outward facing surfaces, the effect of the twist in the belt is to provide a single endless line of flutes 32 extending along both surfaces. The flutes 32 are dimensioned the same as the flutes 8 in the belt 10.

As the tipped ends T of the cigarettes engage in the flutes 32, the tobacco portion of each cigarette in turn is supported by a plate 42 positioned below the drum 30, alongside the belt 34. A thin flexible strip 44, similar to strip 22 described above, extends between blocks 46, 48 and is held under tension to lie across the open side of flutes 32 and prevent the contained cigarettes from falling out. A fixed guide (not shown), similar to guide 26 described above, is provided to prevent endwise downward movement of the cigarettes as they are being turned.

When the cigarettes have been turned through 180 degrees by belt 34, the flutes 32 containing them are on the inside surface of the belt 34, and the cigarettes are fed into flutes 50 formed in the outer surface of a hollow sleeve 52 which forms part of the pulley 38. The sleeve 52 rotates about a stationary hub 54 provided with a circumferential slot 56 to which suction is applied from any convenient source (not shown), and the sleeve 52 is long enough to support the cigarettes C along their whole length. A bridge piece 57 is provided to support the cigarettes as they pass between the end of strip 44 and the sleeve 52. As the sleeve 52 rotates, suction is applied to each flute 50 via a number of radial holes 58 so that the cigarettes are held in the flutes 50. The depth of the flutes 50 is such that the cigarettes protrude from the sleeve 52 by a distance equal to approximately half their diameter.

At the bottom of the pulley 38, the belt 34 passes away therefrom and the cigarettes are lifted out of the flutes 32. When the cigarettes have been lifted completely clear of belt 34, the end faces of the tipped ends of the cigarettes are engaged by a fixed cam 60 which, on continued rotation of sleeve 52, causes the cigarettes to move along their respective flutes 50 to a position opposite a fluted drum 62, rotatably mounted alongside the belt 34. Just after passing away from cam 60, the suction is cut off from the flutes 50 and applied to the flutes in drum 62 so as to transfer the cigarettes to the drum 62, from which they are fed to further apparatus forming no part of the present invention. To prevent any slipping of the belt 34 on the pulleys 36, 38, and thus maintain the timing of flutes 32 relative to the flutes in drum 30, the pulley 36 is provided with teeth 64 which engage in the flutes 32 on the inside face of belt 34.

In an alternative arrangement the belt 34 is replaced by a belt (not shown) having flutes formed in only one of its surfaces (i.e. similar to the belt 10, FIG. 1). In order that the flutes in such a belt are facing outwards when they receive a cigarette from drum 30, a second 180 degree twist is provided along its lower run, in addition to the 180 degree twist in its upper run for turning the cigarettes. The direction of twist in the lower run is preferably opposite to that in the upper run so as to restore the belt to its original state and permit the use of a normal belt without any built in twist.

We claim:

1. Apparatus for tip-turning cigarettes comprising first and second conveyor means for feeding cigarettes sideways in succession and spaced apart in the direction of feed; an endless twisted flexible belt adapted to receive cigarettes from said first conveyor means, to tip-turn the cigarettes and to deliver the tip-turned cigarettes to the second conveyor means, said endless belt having flutes therein to receive the cigarettes from the first conveyor means and to hold the cigarettes therein in a non-gripping manner; and cover means in the form of a member separate from said flexible belt and extending along the open sides of the flutes to retain the cigarettes in their respective flutes without exerting constant pressure on them while they are being tip-turned.

2. Apparatus according to claim 1 in which the cover means comprises a fixed member having a twisted surface corresponding to the twist of the flexible belt.

3. Apparatus according to claim 2 in which the cover means comprises a stationary flexible strip which is fixed at both ends and is tensioned so as to follow the twisted path of the belt.

4. Apparatus according to claim 3 in which the flexible strip rubs lightly on the belt to retain the cigarettes in the flutes of the belt.

5. Apparatus according to claim 3 in which the flexible strip is slightly spaced from the belt.

6. Apparatus according to claim 1 including stop means for engaging the ends of the cigarettes to prevent downward movement of the cigarettes in their respective flutes under gravity while they are being turned.

7. Apparatus according to claim 6 in which the stop means comprises a stationary guide.

8. Apparatus according to claim 6 in which the stop means comprises parts integral with the belt.

9. Apparatus according to claim 1 in which the flexible belt extends between two spaced pulleys lying on opposite sides of the conveyance path of the cigarettes and is formed in a figure of eight configuration.

10. Apparatus for tip-turning cigarettes comprising first and second conveyor means for feeding cigarettes sideways in succession and spaced apart in the direction of feed; an endless twisted flexible belt adapted to receive cigarettes from said first conveyor means, to tip-turn the cigarettes and to deliver the tip-turned cigarettes to the second conveyor means, said endless belt having flutes therein to receive the cigarettes from the first conveyor means; and cover means adapted to extend along the open sides of the flutes to retain the cigarettes in their respective flutes while being tip-turned, in which the belt forms a simple loop around two pulleys and has flutes in both faces, the cigarettes being received from the belt by the downstream pulley and being transferred from that pulley after axial displacement taking them clear of the belt.

11. Apparatus for tip-turning cigarettes comprising means including an endless twisted flexible belt adapted to receive cigarettes having a generally horizontal disposition and to rotate said cigarettes through 180 degrees to tip-turn the cigarettes, said endless belt having therein flutes dimensional in depth and width to be substantially equal to the diameter of said cigarettes so that said cigarettes are received and held without compression therein; and cover means extending along open sides of said flutes to retain the cigarettes in their respective flutes while being tip-turned.

12. Apparatus according to claim 11, wherein said endless belt is positioned to receive only an end portion of said cigarettes in said respective flutes, and said cover means operates to prevent rotation of said cigarettes with respect to the flutes in which they are carried for purposes of tip-turning.

* * * * *